US006132587A

United States Patent [19]

Jorné et al.

[11] Patent Number: 6,132,587

[45] Date of Patent: Oct. 17, 2000

[54] UNIFORM ELECTROPLATING OF WAFERS

[76] Inventors: Jacob Jorné; Judith Ann Love, both of 359 Westminster Rd., Rochester, N.Y. 14607

[21] Appl. No.: 09/174,337

[22] Filed: Oct. 19, 1998

[51] Int. Cl.[7] ..... C25D 5/02; C25D 5/08; C25D 5/20; C25D 17/00; C25D 15/00

[52] U.S. Cl. ..... 205/123; 205/133; 205/148; 205/157; 204/224 R; 204/263; 204/229.6; 204/DIG. 7

[58] Field of Search ..... 204/224 R, 212, 204/229.6, DIG. 7, 263; 205/123, 137, 133, 103, 148, 157

[56] References Cited

U.S. PATENT DOCUMENTS

| | | | |
|---|---|---|---|
| 4,304,641 | 12/1981 | Grandia et al. | 204/DIG. 7 |
| 5,230,743 | 7/1993 | Thompson et al. | 134/32 |
| 5,391,285 | 2/1995 | Lytle et al. | 204/224 R X |
| 5,421,987 | 6/1995 | Tzanavaras et al. | 204/224 R X |
| 5,429,733 | 7/1995 | Ishida | 204/224 R |
| 5,437,777 | 8/1995 | Kishi | 204/224 R |
| 5,445,172 | 8/1995 | Thompson et al. | 134/153 |
| 6,001,235 | 12/1999 | Arken et al. | 205/137 |
| 6,042,712 | 3/2000 | Mathieu | 205/209 |

OTHER PUBLICATIONS

J. Jorné, Current Distribution of Copper Electroplating on Wafers, Report, Cupricon, Inc., Rochester, NY (Jul. 24, 1997).

H.S. Rathole and D. Nguyen, Copper Metallization for Sub–Micron Technology in Advance Metallization Processes, VLSI Multilevel Interconnection, Santa Clara, CA, Jun. 9, 1997.

P. Singer, Making the Move to Dual Damascene Processing, Semiconductor International, pp. 79–82, Aug. 1997.

P. Singer, Copper Goes Mainstream: Low k to Follow, Semiconductor International, pp. 67–70, Nov. 1997.

V.M. Dubin, C.H. Ting and R. Cheung, Electrochemical Deposition of Copper for ULSI Metallization, paper 3.A, VLSI Multilevel Interconnection Conference, Jun. 10–12, 1997.

M. Witty, S.P. Murarka and D.B. Fraser, SRC Workshop on Copper Interconnect Technology, Semiconductor Research Corporation, Research Triangle Park, NC, Aug. 17–18, 1993.

VLSI Multilevel Interconnection Conference, VMCI, Santa Clara, CA, Jun. 10–12, 1997.

*Primary Examiner*—Donald R. Valentine

*Attorney, Agent, or Firm*—Flehr Hohbach Test Albritton & Herbert LLP

[57] ABSTRACT

The non-uniformity of electroplating on wafers is due to the appreciable resistance of the thin seed layer and edge effects. Mathematical analysis of the current distribution during wafer electroplating reveals that the ratio between the resistance of the thin deposited seed layer and the resistance of the electrolyte and the electrochemical reaction determines the uniformity of the electroplated layer. Uniform plating is critical-in-wafer metallization for the subsequent step of chemical mechanical polishing of the wafer. Based on the analysis, methods to improve the uniformity of metal electroplating over the entire wafer include increasing the resistance of the electrolyte, increasing the distance between the wafer and the anode, increasing the thickness of the seed layer, increasing the ionic resistance of a porous separator placed between the wafer and the anode, placement of a rotating distributor in front of the wafer, and establishing contacts at the center of the wafer. The rotating distributor generates multiple jets hitting the surface of the wafer, thus ensuring conformal electroplating. The jets can be either submerged in the electrolyte or above the level of the electrolyte. The shape and uniformity of the electroplated layer can be also determined by the shape and relative size of the counter-electrode (anode), by masking the edge of the wafer and by periodically reversing the plating current. The problem of uniformity is more severe as the diameter of the wafer becomes larger.

37 Claims, 5 Drawing Sheets

UNIFORM ELECTROPLATING OF WAFERS

RELATED U.S. APPLICATION DATA

References Cited

U.S. Patent Documents

| | | |
|---|---|---|
| 5,230,743 | 7/1993 | Thompson et al. |
| 5,429,733 | 7/1995 | Ishida |
| 5,445,172 | 8/1995 | Thompson et al. |

OTHER PUBLICATIONS

J. Jorne, Current Distribution of Copper Electroplating on wafers, Report, Cupricon, Inc., Rochester, N.Y. (Jul. 24, 1997).

H. S. Rathore and D. Nguyen, Copper Metallization for Sub-Micron Technology, in Advance Metallization Processes, VLSI Multilevel Interconnection, Santa Clara, Calif., Jun. 9, 1997.

P. Singer, Making the Move to Dual Damascene Processing, Semiconductor International, p. 79–82, August 1997.

P. Singer, Copper Goes Mainstream: Low k to Follow. Semiconductor International, pp. 67–70, November 1997.

C. H. Ting, V. M. Dubin and R. Cheung, Electrochemical Deposition of Copper for ULSI Metallization, paper 3.A, VLSI Multilevel Inteconnection Conference (1997).

M. Witty, S. P. Muraka and D. B. Fraser, SRC Workshop on Copper Interconnect Technology, Semiconductor Research Corporation, Research Triangle Park, N.C. (1993).

VLSI Multilevel Inteconnection Conference, VMCI, Santa Clara, Calif. (1997).

Attorney, Agent, or Firm-Jorne & Love, 359 Westminster Road, Rochester, N.Y. 14607.

SUMMARY OF THE INVENTION

The non-uniformity of electroplating on wafers is due to the appreciable resistance of the thin seed layer and edge effects. Mathematical analysis of the current distribution during wafer electroplating reveals that the ratio between the resistance of the thin deposited seed layer and the resistance of the electrolyte and the electrochemical reaction determines the uniformity of the electroplated layer. Uniform plating is critical in wafer metallization for the subsequent step of chemical mechanical polishing of the wafer. Based on the analysis, methods to improve the uniformity of metal electroplating over the entire wafer include increasing the resistance of the electrolyte, increasing the distance between the wafer and the anode, increasing the thickness of the seed layer, increasing the ionic resistance of a porous separator placed between the wafer and the anode, establishing contacts at the center of the wafer, and jet electroplating by placement of a rotating distributor in front of the wafer. The rotating distributor generates multiple jets hitting the surface of the wafer, thus ensuring conformal electroplating. The jets can be either submerged in the electrolyte or above the level of the electrolyte. The distribution of holes in the distributor determines the distribution of electroplated metal on the wafer. The shape and uniformity of the electroplated layer can also be determined by the shape and relative size of the counter-electrode (anode), by masking the edge of the wafer and by periodically reversing the plating current. The problem of uniformity is more severe as the diameter of the wafer becomes larger.

BACKGROUND OF THE INVENTION

1. Field of the Invention

The present invention relates to a plating device for achieving uniform plating of a wafer.

2. Background

Copper Interconnect Technology

One of the primary challenges in IC design and fabrication is overcoming signal propagation delays, which are caused by resistance and capacitance within devices and interconnects. In high-speed circuits, the RC time delay becomes important in the form of a need for high conductivity. The high speed, combined with smaller dimensions, has made interconnect technology the focal point of current research and development. There is no question that the need for low RC will requires the use of new materials of lower resistance, such as copper, and low dielectric, such as polymers.

Aluminum is the most commonly used metal for metallization, along with its alloys and various suicides. However, in order to increase the conductivity, copper is expected to replace aluminum in the sub-0.25 $\mu$m technology, which is expected to be introduced into manufacturing within the very near future. Multilevel interconnect (MLI) technology will be used and consequently the interconnect current densities will be doubled, while contacts and cross-sectional areas will be decreased. This will result in higher power dissipation, calling for the introduction of highly reliable copper interconnect technology.

Cooper appears to offer low RC performance and high reliability over the commonly used aluminum alloys. The current approaches to copper metallization include CVD (blanket and selective), selective electroless deposition, sputtering (PVD) and electrodeposition. The common approaches to copper patterning include CMP, RIE and selective deposition. Copper CVD is based on two precursor chemistries, commonly used for Cu(I) and Cu(II) (see Witty et al., 1993). The growth rate is about 50 nm/min and the resistivity is 2 m$\Omega$-cm. Selective CVD of copper is preferred because fewer steps are needed, it is less expensive and smaller contacts and via can be filled. Many new and highly volatile Cu precursors have been developed, ranging from volatile solid Cu(I) coordination compounds to volatile liquid Cu(I) organometallics, which are capable of fast deposition of high purity Cu films at moderate temperatures. However, the various CVD processes for copper are expensive and relatively slow. It appears that electrochemical deposition of copper is the leading technology, as it offers low cost and fast deposition process. The main problems facing the commercialization of copper interconnect electrodeposition are the non-uniformity of the Cu layer over the wafer and the filling of small, high aspect ratio contact holes without void formation.

Because copper reacts with $SiO_2$, it is necessary to form a barrier layer first. Tantalum (Ta) or tantalum nitride (TaN) are pre-deposited on the $SiO_2$ by sputtering. Cu seed layer is needed next for good electrical contact and adhesion, thus thin Cu seed layer (500–1000 A) is formed by sputtering or by CVD. In order to avoid any contact between the devices and copper, the first contact holes are filled with tungsten (W) sputtering. Copper electroplating is obtained from an aqueous solution of $CuSO_4$ and $H_2SO_4$, in the presence of several additives and leveling agents. The electroplating is performed while the wafer is rotating at a speed of up to 2,000 rpm, while the electrolyte is pumped against the wafer in the form of a stagnation flow. Electrical contacts are established by hooks or a contact ring attached to the periphery of the wafer. This creates non-uniform current distribution due to the non-uniformity of the rotating disk geometry and due to the low resistivity of the thin copper layer (terminal effect). Using 8" wafer, the non-uniformity of the layer thickness reaches 9–15% 1σ, as the thickness at the edge is 13–15 KA, while in the center the thickness is 7.5–10 KA. This results in loosing as much as 1.5" of edge during polishing, as the edge remains Cu-covered while the center area is completely polished. Commercial electroplating units include Equinox and LT-210 made by Semitool, Mont. (U.S. Pat. Nos. 5,230,743 and 5,445,172), in which the wafer is held by flexibly mounted gripping fingers. Another source is EEJA (Electroplating Engineers of Japan), where the contact hooks are replaced by a contact ring and air bag (U.S. Pat. No. 5,429,733). All these electroplating systems suffer from non-uniform distribution of plating, resulting in excess of electroplated metal at the circumference edge of the wafer. Literature on copper technology is available at VMIC conference proceedings (Rathore & Nguyen 1997, Ting 1997, VMIC 1997).

Copper interconnect technology requires the use of damascene processing because etching of copper is extremely difficult. Damascene processing involves the formation of interconnect lines by first etching trenches in a planar dielectric layer, and then filling these trenches with the metal, such as aluminum or copper (Singer 1997). After filling, the metal and the dielectric are planarized by chemical-mechanical polishing (CPA). In dual damascene processing, a second level is involved where series of holes (contacts or via) are etched and filled in addition to the trenches. Dual damascene will mostly be the patterning choice for copper interconnects (Singer 1997).

Current Distribution of Metal Electroplating on Wafers

The current distribution for metal electroplating on wafers has been analyzed (see Jorne 1997). The non-uniformity of the plating is due to the appreciable resistance of the thin seed layer and the geometry of the electroplating system. When the current is fed from the circumference edge of the wafer, a non-uniform plating occurs as thicker metal deposit occurs at the edges. The ratio between the resistance of the thin metal layer and the resistance of the electrolyte and the electrochemical reaction determines the uniformity of the electroplating. Increasing the diameter of the wafer and the resistivity of the seed layer results in non-uniformity, while increasing the resistivity of the electrolyte and the electrochemical reaction results in higher uniformity.

A mathematical analysis of the plating current distribution over the wafer (Jorne 1997) shows that the electroplating current density is given by $$i_z/i_{avg}=(B/2)I_0(Bx)/I_1(B)$$

where $i_z$ and $i_{avg}$ are the local and average current densities, respectively. $I_0$ and $I_1$ are the modified Bessel functions of order 0 and 1, respectively. x=r/R is the ratio of the local radius r to the outer radius of the wafer R, and B is the plating uniformity parameter defined by $$B^2=(\rho/\rho_{el})(R^2/Wd)$$

where ρ and $\rho_{el}$ are the resistivities of the electroplated metal and the electrolyte, respectively, R is the radius of the wafer, W is the thickness of the seed layer and d is the distance between the wafer and the counter electrode. In order to ensure uniformity during electroplating, the electroplating system must obey that the value of B is smaller than unity: $B^2 \leqq 1$. The current distribution, and hence the thickness distribution of the electroplated metal depends on a single parameter B, which represents the ratio between the resistance of the deposit and the electrochemical resistance of the electrolyte and the electrochemical reaction. For small B ($B^2 \leqq 1$), the plating distribution is fairly uniform, however, for large B ($B^2 \geqq 1$), the plating distribution becomes progressively non-uniform as the deposit at the circumference becomes thicker.

SUMMARY OF THE INVENTION

The present invention describes several electroplating devices for the uniform metallization of wafers for interconnect technology. The invention addresses in particular the problem of achieving uniform plating distribution over the entire wafer and the conformity to sub-micron features. The wafer, on which a thin barrier layer and seed layer are pre-deposited, is brought in contact with an electrolytic solution made of a salt of the metal to be deposited, supporting electrolytes and leveling agents. Because the seed layer is very thin, the electroplating rate becomes lower at further distances from the contact point, as the electrical current has to flow through the high-resistance thin seed layer. In conventional wafer plating systems, the wafer is held at its edge by gripping fingers or a contact ring, through which the electrical current is fed. This usually results in higher plating at the circumference edge, creating severe problems during the subsequent chemical-mechanical polishing step. In the present invention, the current distribution during wafer electroplating is mathematically analyzed. The uniformity of electroplating depends on the ratio of the resistance of the seed layer to the resistance of the electrolyte and the electrochemical reaction. Uniformity of electroplating can be achieved by maintaining the uniformity parameter B below a certain value, usually below unity. This can be achieved by decreasing the seed layer resistance, increasing the electrolyte resistance, increasing the distance between the wafer and the counter electrode, by a jet electroplating using a rotating distributor, and by increasing the electrical resistance of a porous separator which is placed between the wafer and the counter electrode. Jet electroplating can be achieved by pumping the electrolyte trough a rotating distributor with small holes (rotating shower head). The resulting multiple jets hit the surface of the wafer thus ensuring uniform and conformal electroplating, in the presence or in the absence of leveling agents and brightening additives. Predetermined distribution of electroplating can be achieved by nonuniform distribution of holes in the distributor. The more holes per unit area results in heavier electrodeposit on the corresponding area of the wafer facing the distributor. Furthermore, the uniformity of the electroplated layer can be determined by the shape and size of the counter electrode and its position relative to the wafer. Uniformity can be achieved also by periodically reversing the current during plating, thus preferentially dissolving the excess metal from areas where the electroplating was higher. In addition, instead of the wafer being electrically connected by contact grips at the edge, the wafer could rest on vertical contact pegs placed in the electrolyte and electrically isolated from the electrolyte. Only the tips of these pegs touch the active side of the wafer to be plated. The wafer, resting on contact pegs or a contact ring, is rotating, while the electrolyte solution is being upwardly pumped against the wafer in order to achieve uniform concentration in the electrolyte, good conformity and uniform plating distribution. The electrical contact points can be also distributed over the entire surface of the wafer, preferentially at the center, thus eliminating thicker electroplating at the edges and ensuring uniformity over the entire wafer.

DESCRIPTION OF PREFERRED EMBODIMENT

The preferred embodiments will be discussed hereinafter with reference to the drawings. The wafer 1 is obtained by lithographic etching and deposition processes, commonly used in the microelectronics industry. The sub-micron width or diameter of the trenches and via holes are, as a typical example, about 0.25 micron, with a high aspect ratio, typically as an example, of about 1:4. Thus the depth of the trenches or holes could be about 1 micron or more. The barrier layer typically consists of Ta or TaN or other metals or compounds capable of preventing the diffusion and reaction of the intended interconnect metal, say copper for example, with the dielectric, say $SiO_2$ for example. The barrier layer is usually obtained by CVD, PVD or sputtering. Seed layer of the metal 10, say copper for example, is deposited on the barrier layer in order to act as the conducting electrode for the subsequent electroplating of the metal. The seed layer is obtained by CVD, PVD or sputtering to a typical thickness of about 0.1 micron. The seed layer is fully conformed to the walls of the patterned trenches and holes and via.

Figure 1:
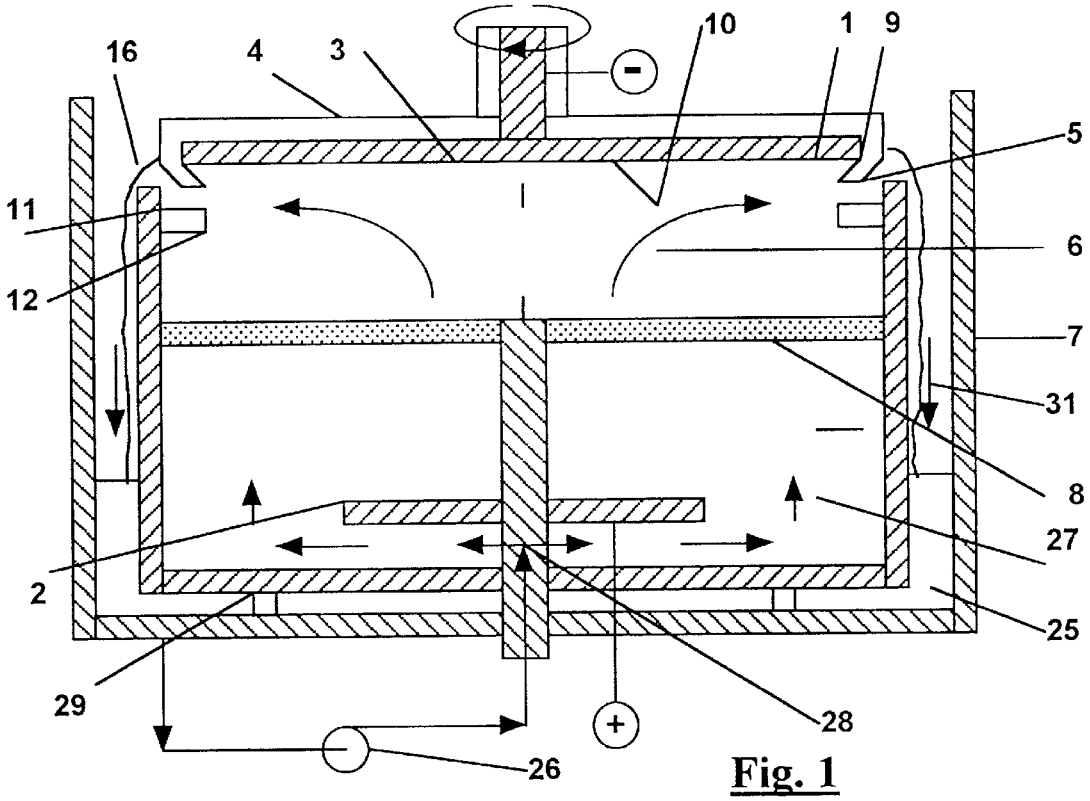
FIG. 1 is a schematic view of an electroplating apparatus, showing the contact fingers or ring and the wafer being rotating while the electrolytic solution is circulated against the wafer. The edge of the wafer is shielded from being heavily plated by an insulating ring.

The wafer 1 is then transferred to the electroplating apparatus 7 as it is facing down gripped by the contacts 9, as shown in FIG. 1. The contacts 9, as shown in FIG. 1, consist of metallic conductor 3, electrically insulated from the electrolytic solution by a plastic insulator 14, except at the tips which are in direct contact with the electroplated metal 10 on the wafer 1. The rotation is designed to ensure uniformity of the plating and averaging possible disturbances. The electrolyte 6 is pumped upwardly against the surface of the wafer to ensure sufficient supply of reacting ions to the surface and into the sub-micron trenches and holes and exits by flowing over the overflow 16 which determines the level of the electrolyte in the apparatus 7. The electrolyte is circulated from outer reservoir 25 by pump 26 into the inner reservoir 27. A porous separator 8 is located between the anode 2 and the wafer 1 to ensure even distribution of the flow 6 over the entire wafer 1. The porosity and thickness of the porous separator 8 also determines the electrical resistance of the electrolyte and the uniformity of the electroplating 10 on the wafer 1. A masking ring 12 is placed at a certain distance from the wafer to shield the edge of the wafer from heavy electroplating there. The anode 2, made of the plated metal, is located below the wafer and is usually smaller in diameter than the wafer itself. The circumference edge of the wafer is masked by a plastic ring 5 which masks the edge by forming a less than 90 degree angle of contact, as shown in FIG. 1. The wafer is resting on the ring 5 and the contacts in such a way that its backside is not submerged in the electrolyte and only the active side of the wafer is in contact with the fountain of electrolyte 6 formed by pumping the electrolyte against the wafer 1.

Figure 2:
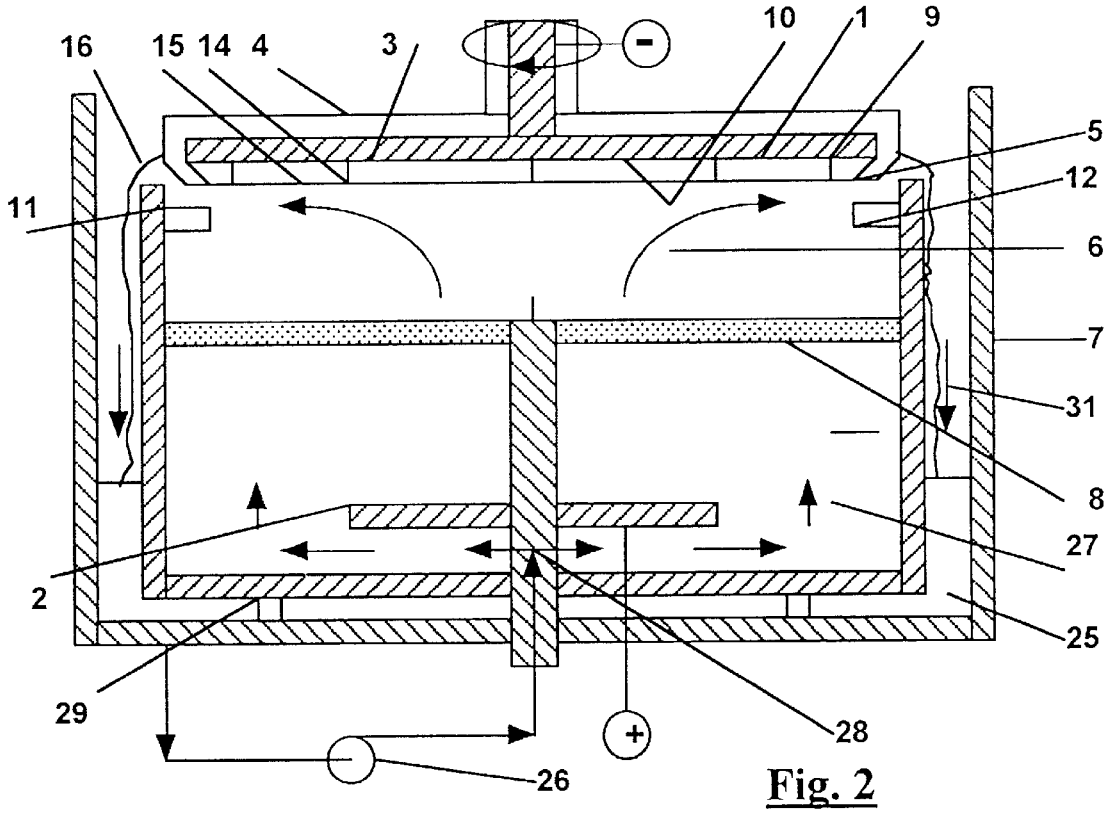
FIG. 2 shows an electroplating apparatus, in which the wafer is resting on several contact pegs vertically located in the electrolyte. The electrical current is distributed over the entire wafer, thus eliminating plating non-uniformity.

FIG. 2 shows a design of an electroplating device where the electrical current is distributed through several contact points 9, thus eliminating the non-uniformity in electroplating. The wafer 1 is resting, facing downward, against several pegs 14 vertically positioned inside the electrolyte. The tips 9 of these pegs 14 are in electrical contact with the active face of the wafer where electroplating is taking place 10. The electrical wires 15 are insulated from the electrolyte by the insulating pegs. The wafer 1 is resting also on an insulating ring 5, which masks the edge of the wafer 1 from developing thick deposit. The entire contact pegs assembly 14 and the insulating ring 5 and the wafer 1 are rotating while electrolyte 6 is pumped upwardly against the surface of the wafer to ensure uniformity and conformity to the high aspect ratio trenches and holes, previously etched in the wafer. A masking ring is placed at a certain distance from the wafer to shield the edge of the wafer from heavy electroplating there. A porous separator 8 is located between the anode 2 and the wafer 1 to ensure even distribution of the flow 6 over the entire wafer 1. The porosity and thickness of the porous separator 8 also determines the electrical resistance of the electrolyte and the uniformity of the electroplating 10 on the wafer 1. The electrolyte is circulated by a pump 26 from the outer reservoir 25, through the feeding pipe 28 into the inner reservoir 27.

Figure 3:
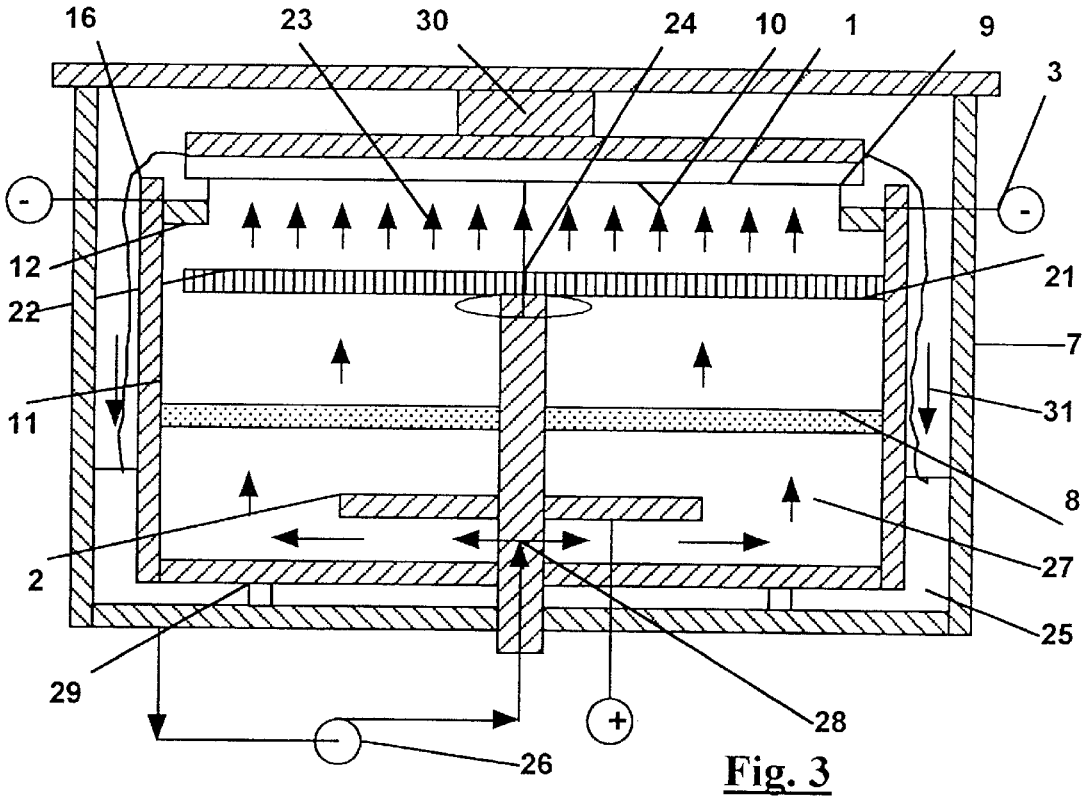
FIG. 3 is a schematic view of submerged jet electroplating apparatus showing a stationary wafer, while the electrolyte is circulated against the wafer through a circular distributor, in which many holes are drilled in an angle in such a way that the circulating electrolyte causes the distributor to rotate. The electrolyte is emerging from the holes as submerged jets, thus improving the conformity and uniformity of the deposit.

FIG. 3 shows a design of electroplating apparatus where the wafer is stationary and a rotating distributor 21 is placed in close proximity to the wafer. The distributor 21 is made of a plastic disk with many holes 22, some are drilled in an angle to the direction of the flow of the electrolyte. The electrolyte is pumped through these holes, causing the distributor to rotate, sending multiple jets of electrolyte 23 impinging on the stationary or rotating wafer 1. The distribution of holes on the rotting distributor determines the local distribution of electroplating on the wafer. The more holes per unit are results in thicker electroplating there. It is possible to set the distribution of electroplating by the density of holes in various radial positions on the distributor. The rotating distributor is resting on a pin 24, centrally located on top of the feed pipe 28. The electrolyte is pumped from the outer reservoir 25 by a pump 26 and into the inner reservoir 27, through an inlet 28 located below the anode 2. The electrolyte passes around the anode 2 and through the porous separator 8, and then upward through the rotating distributor 21 and emerges in the form of multiple jets 23 impinging on the wafer 1. The electrolyte 6 then overflows over the smooth edge 16 of the inner reservoir 27 to the outer reservoir 25. A plastic ring 5 shields the edge of the wafer from heavy electroplating there. The electrical contacts 9 are made from the metal being deposited (e.g. copper) and are not insulated, thus serving as current thieves, preventing heavy deposit at the contact points. The inner reservoir 11 is placed inside the outer reservoir 7 and resting on several legs 29. A porous separator 8 is placed between the anode 2 and the rotating distributor 21 in order to increase the electrical resistivity of the electrolyte 6. The wafer 1 is resting on several electrical contacts 9 and the current is fed by wires 3. The wafer 1 is pressed against the contacts 9 by the cover of the reservoir 30.

Figure 4:
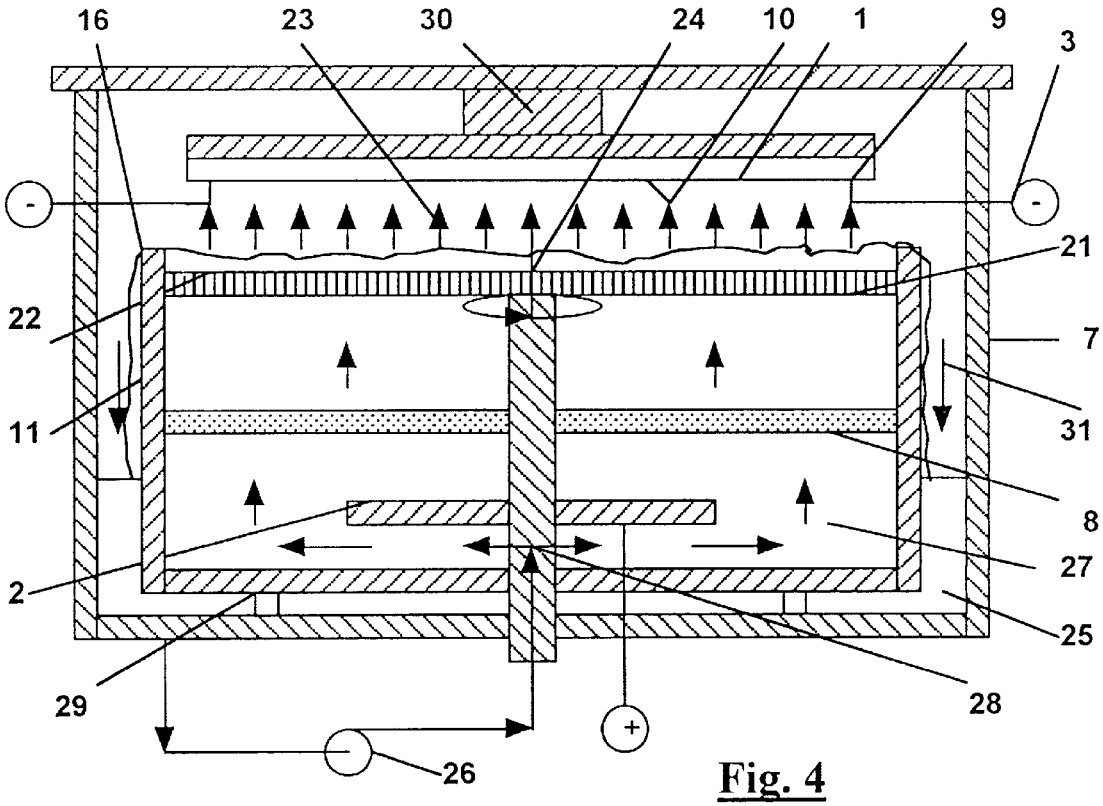
FIG. 4 is a schematic view of jet electroplating apparatus in which the electrolyte level is maintained below the wafer, and where the electrolyte is pumped through a rotating distributor and forms multiple jets hitting the wafer. The wafer is not submerged in the electrolyte and only the multiple jets serve as electrolyte paths for the current.

FIG. 4 shows a design of an electroplating apparatus in which the wafer is stationary and the level of the electrolyte is maintained below the face of the wafer. The electrolyte is pumped by a pump 26, through the inlet 28 into the inner reservoir 27, where it flows around the anode 2 and up against the rotating distributor 21. The distributor is made of a plastic disk through which many holes 22 are drilled, some in an angle to the direction of the flow. This allows the distributor 21 to rotate, while the electrolyte emerges in the form of multiple jets, hitting the face of the stationary or rotating wafer 1. The distributor rests on a pin 24, centrally located on top of the inlet pipe 28. The electrolyte overflows over the smooth edge 16 of the wall 11 of the inner reservoir 27 into the outer reservoir 25. The inner reservoir 11 is placed inside the outer reservoir 7 and stands on several legs 29. The distance between the rotating distributor and the wafer is small to allow an effective impinging flow which is necessary to achieve conformity and uniformity during the electroplating of the wafer. The overflow maintains that the level of the electrolyte in the inner reservoir 27 is slightly above the rotating distributor 21.

Figure 5:
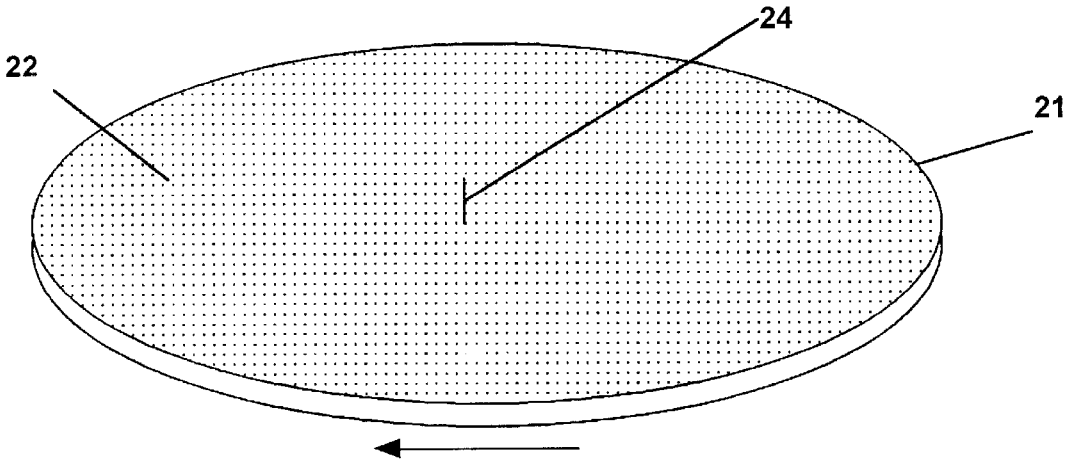
FIG. 5 shows a schematics of the rotating distributor. The electrolyte is pumped through the holes of the distributor and emerges as multiple jet hitting the wafer. Some of the holes are drilled in an angle, causing the distributor to rotate.

FIG. 5 shows the rotating distributor 21. It consists of plastic disk through which multiple holes 22 are drilled. Some of the holes are drilled in an angle to the flow direction, thus causing the distributor 21 to rotate around its axis 24. The electrolyte emerges from the holes as multiple jets, hitting the surface of the wafer, where electroplating takes place.

We claim:

1. An electroplating device for wafer metallization of a wafer for interconnection comprising:

a reservoir for electrolyte, a holder adapted to hold the wafer above said reservoir, a counter-electrode in said reservoir, means adapted for passing current between said counter-electrode and the wafer in said holder, a pump adapted for pumping electrolyte from said reservoir against the wafer in said holder, and a non-conducting porous separator between said wafer holder and said counter-electrode.

2. An electroplating device for wafer metallization of a wafer for interconnection comprising:

a reservoir for electrolyte, a holder adapted to hold the wafer above said reservoir, a counter-electrode in said reservoir, said counter-electrode disposed concentrically with said holder, means adapted for passing current between said counter-electrode and the wafer in said holder, a pump adapted for pumping electrolyte from said reservoir against the wafer in said holder, and wherein the diameter of said counter-electrode is smaller than the diameter of said wafer holder.

3. An electroplating device for wafer metallization of a wafer for interconnection comprising:

a reservoir for electrolyte, a holder adapted to hold the wafer above said reservoir, a counter-electrode in said reservoir, means adapted for passing current between said counter-electrode and the wafer in said holder, a pump adapted for pumping electrolyte from said reservoir against the wafer in said holder, and a distributor positioned in said reservoir and formed with holes at an angle to the flow direction of the electrolyte whereby electrolyte causes rotation of said distributor and emerges from said distributor in the form of multiple submerged jets adapted to contact a face of said wafer held in such holder.

4. An electroplating device for wafer metallization of a wafer for interconnection comprising:

a reservoir for electrolyte, a holder adapted to hold the wafer above said reservoir, a counter-electrode in said reservoir, means adapted for passing current between said counter-electrode and the wafer in said holder, a pump adapted for pumping electrolyte from said reservoir against the wafer in said holder, and means for periodically reversing current adapted to remove excess electroplating metal from areas on the wafer in said holder where the electroplating is thicker than the average and wherein the total electrical charge passed during the reversed current period is smaller than the total charge passed during the forward current period.

5. An electroplating device for wafer metallization of a wafer for interconnection comprising:

a reservoir for electrolyte, a holder adapted to hold the wafer above said reservoir, a counter-electrode in said reservoir, means adapted for passing current between said counter-electrode and the wafer in said holder, a pump adapted for pumping electrolyte from said reservoir against the wafer in said holder, and means for applying pulsed current to said pump during the electroplating process.

6. An electroplating device for the metallization of wafers for interconnection comprising an electroplating apparatus having a reservoir adapted to contain electrolyte, a holder for a wafer coated with a thin barrier layer and a thin seed layer of the metal to be electroplated, an assembly of contact pegs on an insulating ring masking the circumferential edge of said wafer and pressing against said wafer, insulating sleeves insulating said pegs from electrolyte in said reservoir except at the points of contact with the wafer, said contact pegs being spatially distributed over the surface of said wafer to ensure uniform electroplating of the metal over the entire wafer, and means for feeding electrical current from a contact to the center of the wafer and from a plurality of contact points at said counter-electrode.

7. An electroplating device for wafer metallization as set forth in claim 6 which further comprises means for rotating said contact pegs assembly and said wafer together.

8. An electroplating device for wafer metallization as set forth in claim 6 which further comprises a pump to pulse electrolyte upward against a wafer held in said holder while said wafer is resting on said contact pegs and said insulating ring.

9. An electroplating device for wafer metallization as set forth in claim 6 which further comprises means for rotating said contact peg assembly and said wafer while said electrolyte is pumped upward against said rotating wafer, said holder supporting said wafer so that an active surface of a wafer is exposed to electrolyte and the opposite side of said wafer is protected from said electrolyte.

10. An electroplating device for wafer metallization as set forth in claim 6 which further comprises means for periodically reversing the current to remove excess electroplating metal from areas on the wafer where the electroplating is thicker than the average and wherein the total electrical charge passed during the reversed current period is smaller than the total charge passed during the forward current period.

11. An electroplating device for wafer metallization as set forth in claim 6 which further comprises means to pulse said pump during the electroplating process.

12. An electroplating device for wafer metallization as set forth in claim 6 wherein said wafer is stationary and which further comprises means for rotating said reservoir.

13. An electroplating device for wafer metallization as set forth in claim 6 which further comprises means for rotating said wafer.

14. An electroplating device for metallization of a wafer coated with a thin barrier layer and a thin seed layer of a metal to be electroplated over the barrier layer with an electrolyte containing an electroplated metal in solution for interconnection comprising:

a reservoir for electrolyte, a holder adapted to hold the wafer above said reservoir, a counter-electrode in said reservoir, means adapted for passing current between said counter-electrode and the wafer in said holder, a pump adapted for pumping electrolyte from said reservoir against the wafer in said holder, means for adjusting the plating parameter $B^2$ of the electrolyte wherein:

$$B^2=(\rho/\rho_{el})(R^2/Wd)\leqq 1$$

where $\rho$ and $\rho_{el}$ are the resistivities of the metal to be electroplated and the electrolyte, respectively, R is the radius of the wafer, W is the thickness of the electroplated metal and d is the distance between said wafer and said counter-electrode.

15. An electroplating device for wafer metallization as set forth in claim 14 which further comprises a distributor in said reservoir positioned in front of said holder, said distributor being formed with holes at an angle to the flow direction of the electrolyte, said distributor being below the level of the electrolyte, and means for forcing electrolyte through said distributor in the form of multiple jets contacting the surface of said wafer in said holder and causing rotation of said distributor, said jets serving as an ionic path for the passage of current between said wafer and said counter-electrode.

16. An electroplating device for wafer metallization as set forth in claim 14 wherein said holder is stationary and which further comprises means for rotating said reservoir.

17. An electroplating device for wafer metallization as set forth in claim 14 which further comprises means for rotating said wafer holder.

18. An electroplating device according to claim 14 which further comprises means for causing relative rotation between said holder and said reservoir.

19. An electroplating device of wafers for interconnection comprising:

a reservoir for electrolyte, a holder adapted to hold a wafer above said reservoir, a counter-electrode in said reservoir, means for passing current between said counter-electrode and a wafer in said holder, a pump for pumping electrolyte from said reservoir against said wafer, and a distributor positioned in said reservoir including a disk having a plurality of holes adapted to provide a flow of electrolyte through the disk that is uniform along a radius of the disk.

20. An electroplating device according to claim 19 which further comprises means for rotating said distributor relative to said holder.

21. A method of electroplating for the metallization of wafers for interconnection comprising:

providing a reservoir containing a counter-electrode, providing a holder above said reservoir, providing a wafer coated with a thin barrier layer and a thin seed layer of the metal to be electroplated over said barrier layer in said holder, placing an electrolyte containing an electroplated metal in solution in said reservoir and adjusting the plating parameter $B^2$ of said electrolyte wherein:

$$B^2=(\rho/\rho_{el})(R^2/Wd)\leqq 1$$

where $\rho$ and $\rho_{el}$ are the resistivities of said metal to be electroplated and said electrolyte, respectively, R is the radius of said wafer, W is the thickness of the electroplated metal and d is the distance between said wafer and said counter-electrode, a pump to pump said electrolyte upward against said wafer, and passing a current between said counter-electrode and said wafer.

22. A method according to claim 21 which further comprises positioning a non-conducting porous separator in said electrolyte above said counter-electrode.

23. A method according to claim 21 wherein the concentration of said electrolyte is such that $B^2\leqq 1$.

24. A method according to claim 21 which further comprises placing leveling agents in solution with said electrolyte to increase charge transfer resistance at a metal/electrolyte interface.

25. A method according to claim 21 wherein the size of said counter-electrode is smaller than the size of said wafer.

26. A method according to claim 21 which further comprises rotating a distributor in said reservoir.

27. A method according to claim 26 in which said distributor is formed with holes at an angle to flow direction whereby electrolyte merges from said distributor in the form of multiple jets submerged in electrolyte directed at a face of said wafer.

28. A method according to claim 27 in which said jets cause rotation of said distributor.

29. A method according to claim 27 wherein said jets perform said step of passing a current between said counter-electrode and said wafer.

30. A method according to claim 21 in which said step of passing current comprises periodically reversing said current, the period of reversed current being smaller than the period of forward current.

31. A method according to claim 21 in which said step of pumping said electrolyte comprises pulsing said pump.

32. A method according to claim 21 which further comprises causing relative rotation between said wafer and said reservoir.

33. A method according to claim 32 in which said reservoir is rotated.

34. A method according to claim 32 in which said wafer is rotated.

35. A method according to claim 21 wherein said step of adjusting the plating parameter comprises adjusting W.

36. A method according to claim 21 wherein the step of adjusting the plating parameter comprises adjusting d.

37. A method according to claim 21 wherein said step of passing a current comprises pulsing said current.

* * * * *